US011187216B1

(12) United States Patent
Ballard, Jr. et al.

(10) Patent No.: US 11,187,216 B1
(45) **Date of Patent: *Nov. 30, 2021**

(54) PLUNGER TOOL FOR RECIPROCATION PUMP

(71) Applicant: KLX ENERGY SERVICES LLC, Houston, TX (US)

(72) Inventors: Bertrom Ballard, Jr., Edmond, OK (US); Justin Steven Merchant, Tuttle, OK (US); Bernt Olsen, Edmond, OK (US)

(73) Assignee: KLX ENERGY SERVICES LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/803,405

(22) Filed: Feb. 27, 2020

Related U.S. Application Data

(62) Division of application No. 15/986,601, filed on May 22, 2018, now Pat. No. 10,655,616.

(51) Int. Cl.
*F04B 19/20* (2006.01)

(52) U.S. Cl.
CPC ..... *F04B 19/20* (2013.01)

(58) Field of Classification Search
CPC ..... F04B 19/20; F15B 15/064; F15B 53/22
USPC ..... 92/128, 136; 28/888.02
See application file for complete search history.

(56) References Cited

U.S. PATENT DOCUMENTS

| | | | | |
|---|---|---|---|---|
| 6,195,863 | B1 | 3/2001 | Blake | |
| 9,174,329 | B1 | 11/2015 | Villines | |
| 10,655,616 | B1 * | 5/2020 | Ballard, Jr. | F04B 53/22 |
| 2003/0084556 | A1 | 5/2003 | Dunlop | |
| 2010/0325888 | A1 | 12/2010 | Hawes | |
| 2011/0030213 | A1 | 2/2011 | Hawes et al. | |

FOREIGN PATENT DOCUMENTS

| | | |
|---|---|---|
| CN | 202528119 | 11/2012 |
| CN | 203335389 | 12/2013 |
| CN | 104290071 | 1/2015 |
| CN | 204366864 | 6/2015 |

* cited by examiner

*Primary Examiner* — Abiy Teka
*Assistant Examiner* — Daniel S Collins
(74) *Attorney, Agent, or Firm* — McAfee & Taft

(57) ABSTRACT

A plunger tool and method relating thereto is designed to remove and insert plungers of a reciprocating pump such as during maintenance and other disassembly operations. The tool has a guide which receives and supports the plunger after removal from, and before reinsertion into, the pump. The tool also has a rack and pinion actuator for moving the plunger.

4 Claims, 6 Drawing Sheets

PLUNGER TOOL FOR RECIPROCATION PUMP

CROSS-REFERENCE TO RELATED APPLICATION

This application is a divisional of U.S. Non-Provisional patent application Ser. No. 15/986,601, filed May 22, 2018, entitled "PLUNGER TOOL FOR RECIPROCATION PUMP", the entire contents of which are incorporated herein by reference.

FIELD

The present disclosure relates generally to plungers used in reciprocating pumps, and in particular, to a plunger tool for removing and installing a plunger.

BACKGROUND

Various kinds of pumps can be used in oilfield operations. One type of pump, for example, is a reciprocating pump. The reciprocating pump can be used to pump fluid such as chemicals, cement, or other media into a well. Reciprocating pumps typically increase the pressure within a cylinder by reciprocating a plunger within the cylinder. Packing is generally used around the plunger and the plunger reciprocates as a crankshaft located within the pump rotates. As the plunger moves outward in the cylinder, the pressure of the fluid inside chamber decreases creating a differential pressure across an inlet valve that then allows the fluid to enter the cylinder. As plunger moves inwards in the cylinder, the pressure of the fluid inside of the cylinder increases creating a differential pressure across an outlet valve that then allows fluid to exit the cylinder.

Maintenance of the pump typically includes repacking of the packing surrounding the plunger and revalving of the inlet and outlet valves mentioned above. To allow repacking or revalving, the pump is disassembled by removing a suction cover plate and removing the plunger. Additional pump components, such as connecting rods and pony rods may need to be stroked out to push out the plunger. However, the plunger is heavy and large, and can be difficult to pull from the pump and reposition back in the pump. Unfortunately, past tools for removing plungers have been difficult to use. Typically, once the tool is locked into the end of the plunger, the user must manually pull the plunger out. Because of the heaviness and size of the plunger, control can be lost as the plunger exits the bore, often resulting in the plunger being dropped to the ground. Additionally, the weight and size of the plunger make it difficult to reposition by traditional tools during reassembly of the pump. Accordingly, maintenance, disassembly and reassembly of the pump often require two or more people, and even then, can be unsafe, time consuming and labor intensive.

Thus, a technique is desired that makes pump maintenance safer, less time consuming, and less labor intensive.

SUMMARY

This disclosure generally concerns a plunger handling tool and method relating thereto. The tool is designed to remove and reinstall plungers from a reciprocating pump such as during maintenance and other disassembly/assembly operations. The tool has a guide which receives and supports the plunger after removal from or reinstallation in the pump.

The tool also has a rack and pinion actuator for moving the plunger to/from the pump to the guide.

More specifically, in accordance with one series of embodiments of the current disclosure, there is provided a plunger tool for a reciprocating pump. The tool comprises a guide, a mating piece, and an actuator. The guide has a first end, a second end and a wall extending from the first end to the second end. The wall is configured to receive and support a plunger removed from the pump. The mating piece is attached to the second end and is configured to engage and mate with a cylinder opening on the pump. The actuator has a rack and a pinion mechanism. Rotational motion of the pinion results in linear motion of the rack. The rack has an attachment end which is configured to attach to the plunger such that linear movement of the rack results in linear movement of the plunger.

Generally, the mating piece is circular and screw mounts into the cylinder opening of the pump. Additionally, in some embodiments, the guide has a bracket mount at the first end and the actuator further comprises a hub having a groove. The groove removably mates with the bracket mount so as keep the actuator stationary with respect to the guide.

In the above embodiments, the actuator can further comprise a gearbox attached to the hub. The gearbox is configured to slidingly receive the rack and to receive a handle having the pinion such that the pinion interacts with the rack to control movement of the rack through the gearbox.

In accordance with another series of embodiments, this disclosure provides for a method of supporting a plunger during maintenance or disassembly of a reciprocal pump. The method comprises the steps of:

- removing a cover plate from a cylinder opening on the pump;
- mating a guide to the cylinder opening of a cylinder containing the pump;
- attaching a first end of a rack to the plunger; and
- using a rack and pinion to move the plunger from the cylinder onto the guide, wherein rotational motion of the pinion results in linear motion of the rack which is attached to the plunger to move the plunger from the cylinder, and wherein the guide supports the plunger after the plunger is moved from the cylinder.

In the method, the guide can have a first end and a second end, and the mating can be by screw mounting the second end into the cylinder opening. Also, the guide can have a bracket mount at the first end, and the pinion as a portion of a handle. In such embodiments, the method further comprises:

- mating a hub attached to a gearbox with the bracket mount so as to keep the actuator stationary with respect to the guide;
- sliding a portion of the rack through the gearbox;
- inserting the pinion portion of the handle into the gearbox so that the pinion engages the rack; and
- turning the handle so as to move the rack and the plunger attached to the rack such that the plunger is moved from the cylinder onto the guide.

In some or all of the above embodiments, the method can further comprise:

- after maintenance or disassembly of the reciprocal pump is complete,
- turning the handle so as to move the rack and the plunger attached to the rack such that the plunger is moved from the guide into the cylinder;
- disengaging the rack from the pinion and the gearbox;
- disengaging the rack from the first end of the plunger; and
- placing the cover plate over the cylinder opening.

DETAILED DESCRIPTION

Figure 1:
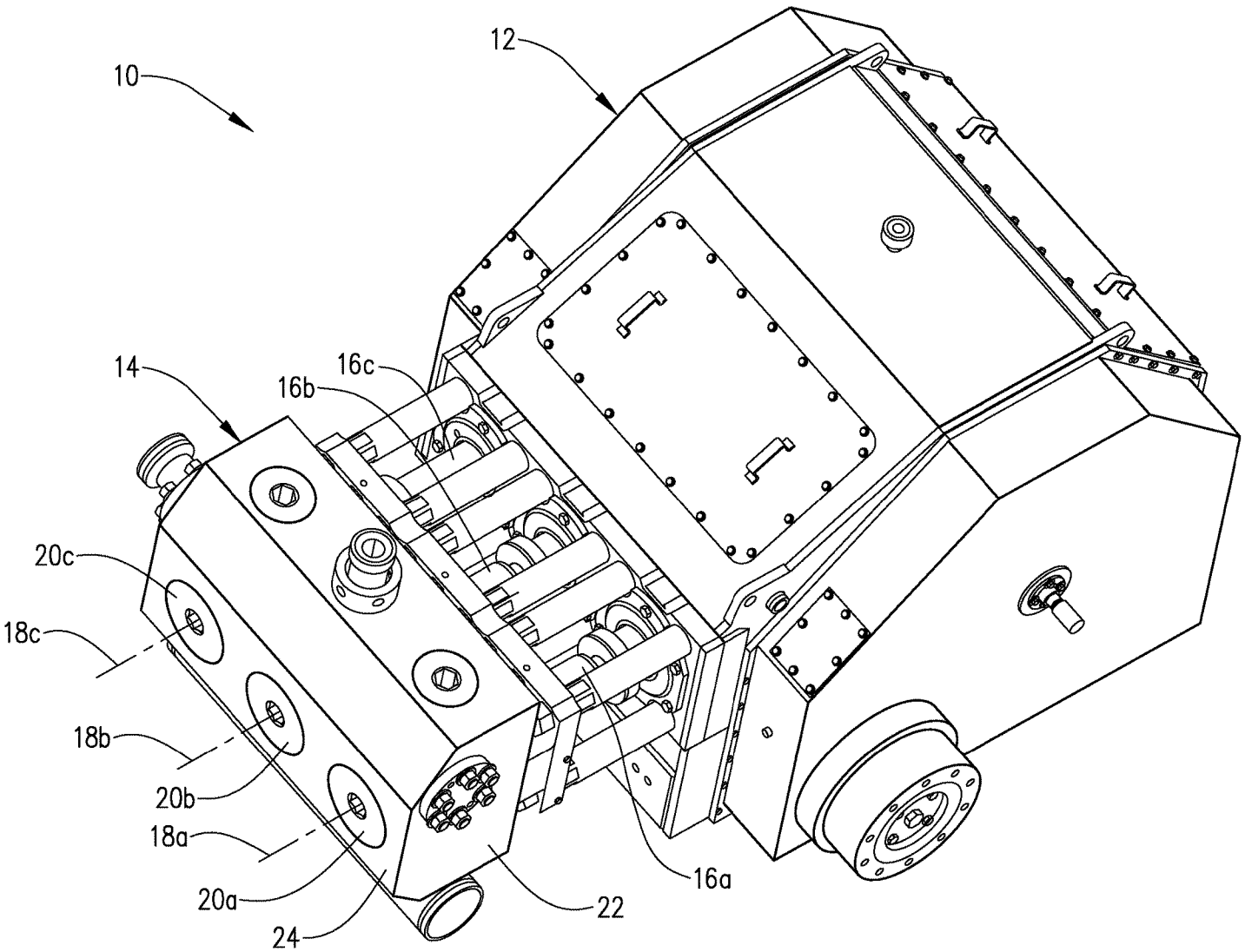
FIG. 1 is a perspective view of a typical triplex reciprocating plunger pump.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "inwardly" and "outwardly" are directions toward and away from, respectively, the geometric axis of a referenced object. Where components of relatively well-known designs are employed, their structure and operation will not be described in detail.

Referring now to FIG. 1, there is shown a typical triplex reciprocating plunger pump 10 with which the plunger tool of this disclosure might be used. Those skilled in the art will realize that the plunger tool will be applicable to other reciprocating pump designs. Plunger pump 10 has a power end 12 and a fluid end 14. The plunger pump assembly has three plunger cylinders or bores with centerlines 18*a*, 18*b* and 18*c*, each corresponding with a plunger 16*a*, 16*b* and 16*c*.

Fluid end 14 includes a pump housing 22. The housing 22 comprises a front plane 24. Each of the three plunger cylinders terminate on front plate 24 in a cylinder opening, which are separately spaced across front plate 24. During normal operation of pump 10, each of the cylinders openings is closed by a cover plate or cap 20*a*, 20*b* and 20*c*.

For maintenance of valves within the housing 22 and for maintenance or changing of the packing seals, it is necessary to remove caps 20*a*, 20*b* and 20*c* on the plunger cylinders located on front plate 24. Once the caps are removed, the plungers 16*a*, 16*b* and 16*c* in the cylinders have to be moved outward to allow appropriate access to the interior of the housing and allow changing of the packing seal and valves. As previously indicated, the plunger is heavy and large, and can be difficult to pull from the pump and reposition back in the pump.

Figure 2:
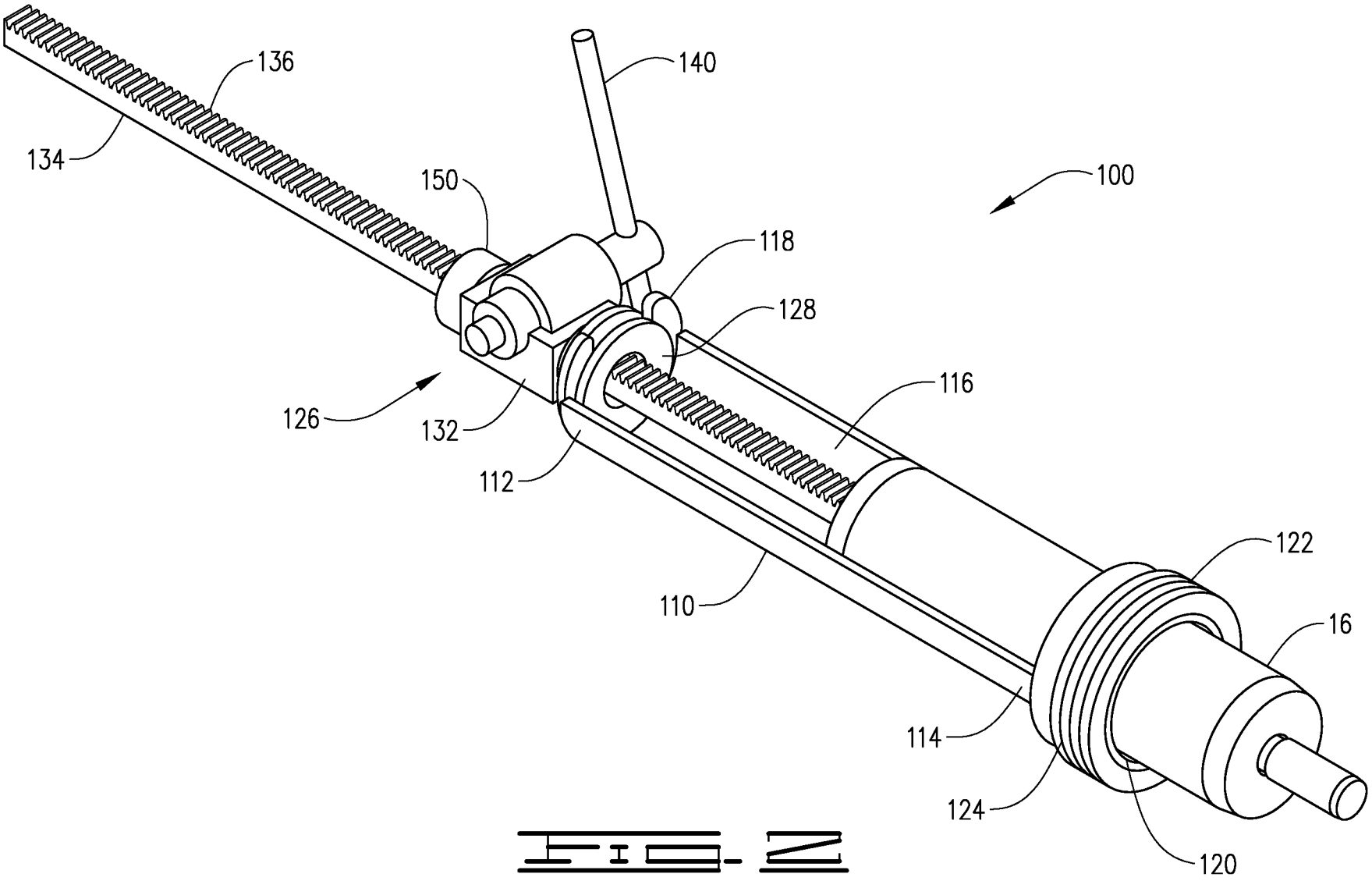
FIG. 2 is a perspective view of a plunger tool in accordance with one embodiment. The plunger tool is illustrated with a plunger but not connected to a pump.
Figure 3:
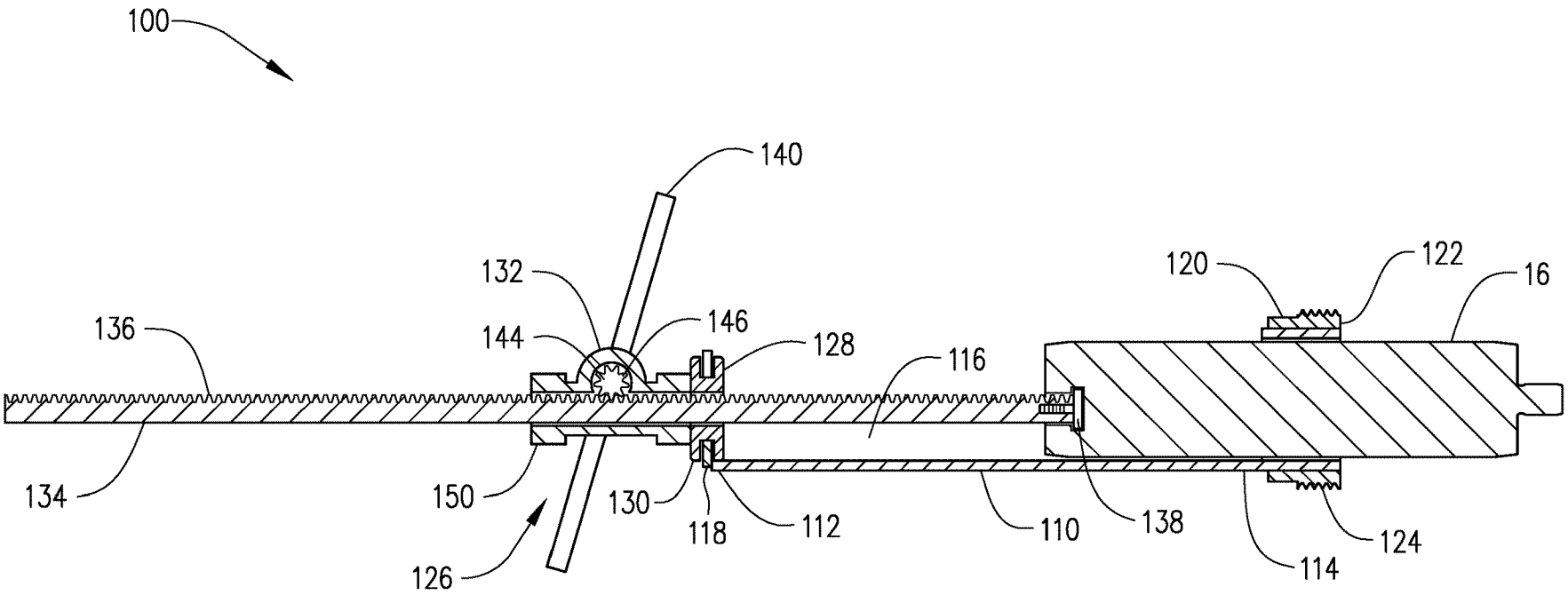
FIG. 3 is a cross-sectional view of the plunger tool illustrated in FIG. 2.
Figure 5:
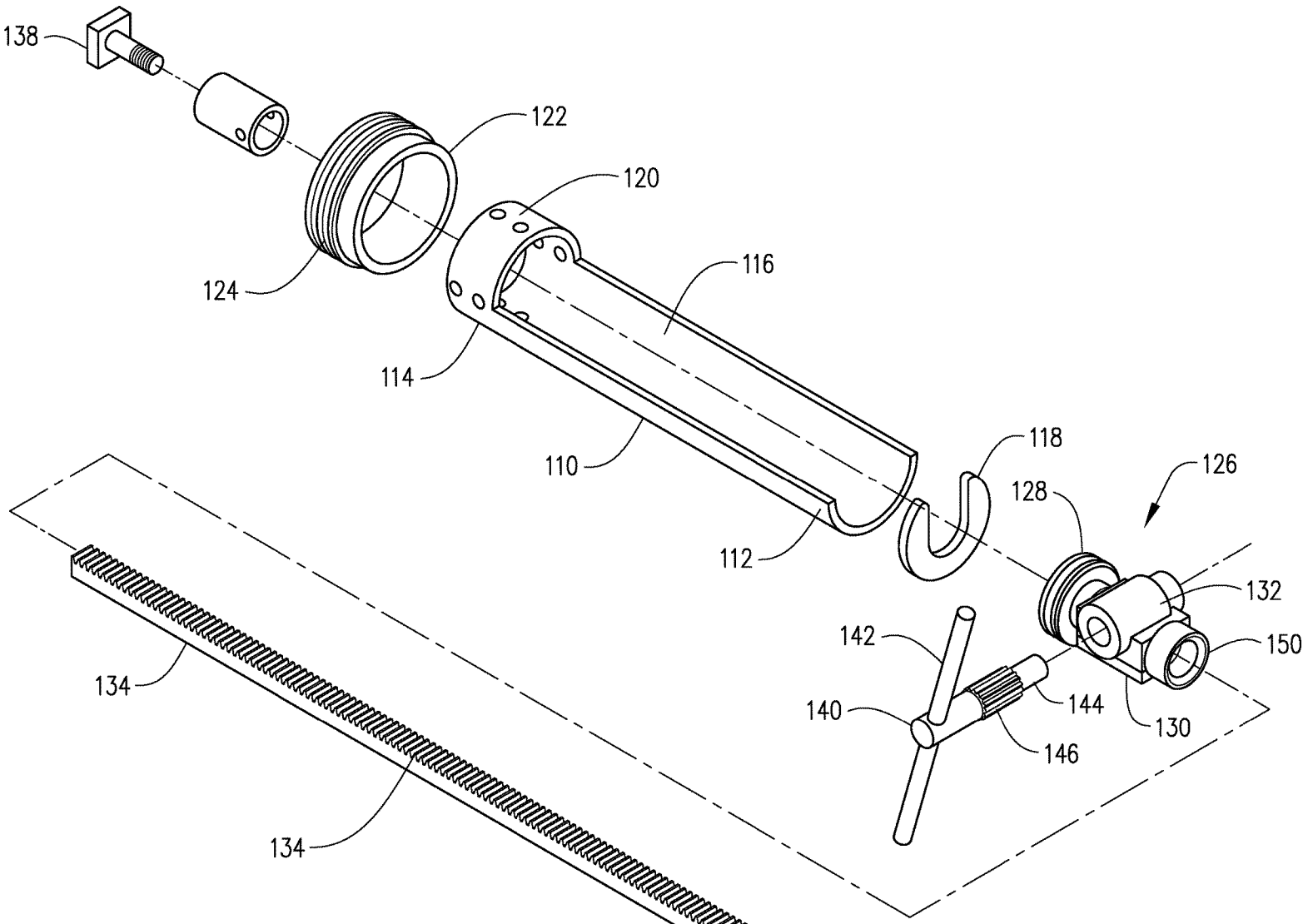
FIG. 5 is an exploded view of the plunger tool illustrated in FIG. 4.

Turning now to FIGS. 2, 3 and 5 an embodiment of the current plunger tool 100 to facilitate removal and reinstallation of a plunger 16 from a reciprocating pump is illustrated. In order not to obscure features, FIGS. 3 and 5 do not show the plunger tool 100 connected to a plunger cylinder of a plunger pump; however, during normal use the plunger tool 100 would typically be connected, as explained below.

Plunger pump 100 comprises a guide 110 having a first end 112, a second end 114 and a wall 116 extending from said first end to said second end. Wall 116 is configured to receive and support a plunger 16 removed from a pump. In some embodiments, wall 116 is a semi-cylinder so as to cradle or nest plunger 16 while still allowing access on the upper side of the guide 110.

At first end 112, guide 110 has a bracket mount 118. At second end 114, guide 110 has a circular ring 120 which is configured so that a mating piece 122 can be attached thereto. Mating piece 122 can be releasably attached such as by a ball bearing and groove releasable connection. Alternatively, mating piece 122 can be integrally formed as circular ring 120 or permanently secured to circular ring 120 by welding or use of steel dowels. Mating piece 122 is configured to engage and mate with the plunger cylinder opening on the plunger pump. Generally, this is done by screw mounting mating piece 122 into the cylinder opening using threads 124 on mating piece 122 and matching threads in the cylinder opening.

Figure 6:
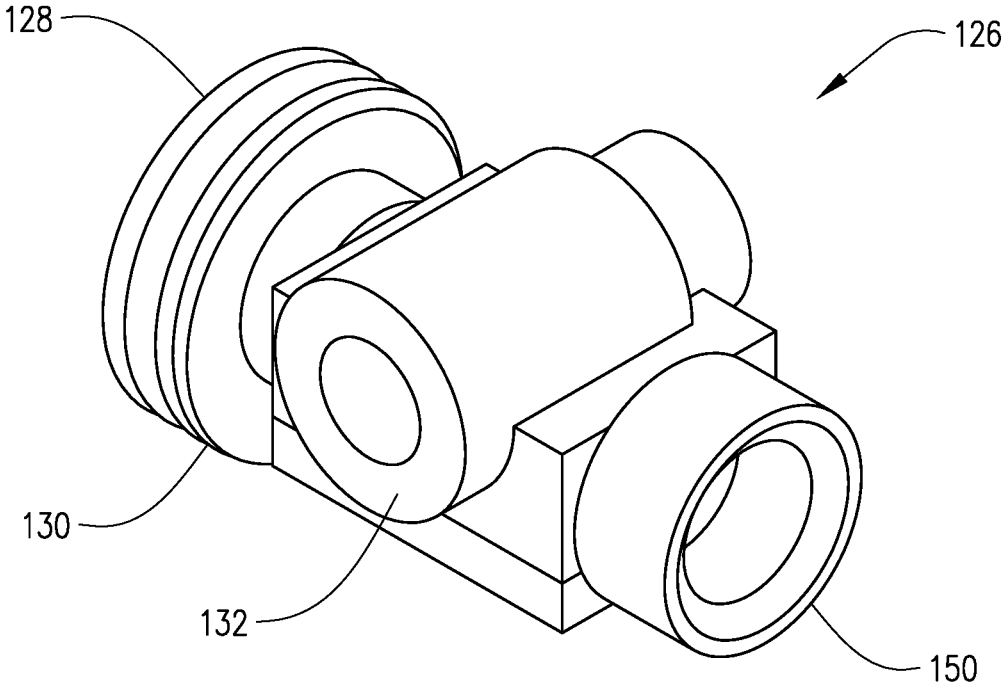
FIG. 6 is an enlarged illustration of the gearbox assembly used in the embodiment of FIGS. 4 and 5.

An actuator assembly 126 is mounted at first end 112 of guide 110. As illustrated in the figures and as can be best seen from FIG. 6, actuator assembly 126 has a circular hub 128, which is configured to have an outer groove 130. Outer groove 130 mates with bracket mount 118 so that hub 128 can be removably mounted on guide 110. When mounted on guide 110, actuator assembly 126 is kept stationary with respect to guide 110. While the circular hub 128 is currently preferred, other mating shapes are within the scope of the invention.

Connected to hub 128 is gearbox 132. Gearbox 132 serves as a housing to slidingly receive a rack 134 such that, when actuator assembly 126 is mounted on bracket mount 118, rack 134 extends longitudinally along wall 116 of guide 110 from first end 112 towards second end 114. Additionally, gearbox 132 serves to receive handle 140, which is a T-bar handle having a hand-grip bar 142 perpendicular to a pinion bar 144. Pinions or gears 146 are circumferentially spaced about pinon bar 144 (best seen from FIG. 5). As will be apparent from the figures, pinion bar 144 is received into gearbox 132 so that pinions 146 engage the gears 136 on the surface of rack 134 such that pinions 146 interact with gears 136 to control movement of rack 134 through gearbox 132. Thus, rotational motion of handle 140 results in linear motion of rack 134 along guide 110. Generally, handle 140 will be received in gearbox 132 so as to allow its removal; thus, allowing removal of rack 134 from gearbox 132. This removable assembly of the gearbox, rack and pinon allows for an easier connection of the rack to the plunger and of the guide to the cylinder opening.

Rack 134 has an attachment end 138, which is configured to attach to plunger 16 such that, when attachment end 138 is attached to plunger 16, linear movement of rack 134 results in linear movement of plunger 16. Typically, the attachment end 138 and the end of plunger 16 have matching male and female mating shapes. After attachment end 138 is inserted into the end of plunger 16, it can be turned through a partial rotation such that it locks into plunger 16 until it is turned back through a partial rotation.

Figure 7:
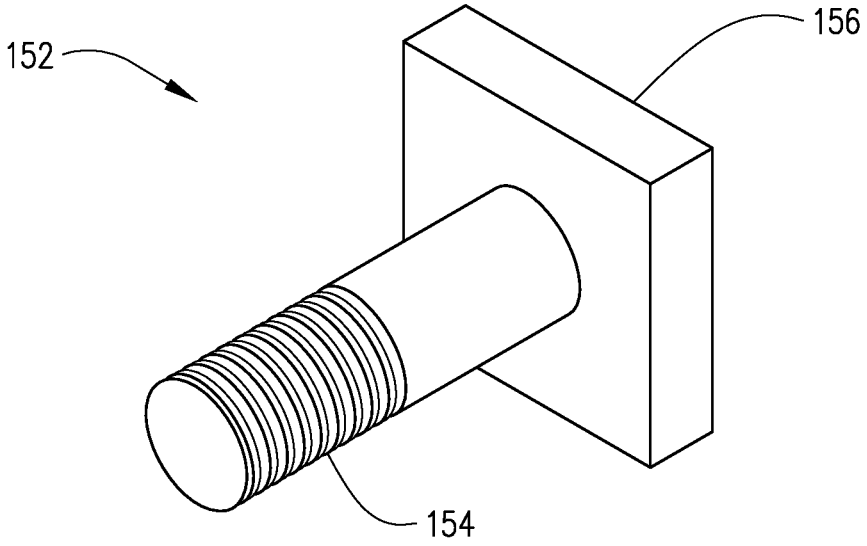
FIG. 7 is a perspective view of the attachment end of a rack in accordance with some embodiments.

As can be seen from FIG. 7, attachment end 138 can be comprised of a removable plunger adapter 152. Adapter 152 is removably attached to attachment end 138 of rack 134 so as to be easily replaced. For example, adapter 152 can have screw threads 154 which mate with matching screw threads in a bore (shown in FIG. 3) defined in attachment end 138, or another suitable attachment that allows easy removal. Adapter 152 has an attachment head 154 configured to attach to a plunger. Because adapter 152 is removably attached to attachment end 138, adapter 152 can be swapped out when a plunger requires a different size and/or different shape of attachment head.

Figure 4:
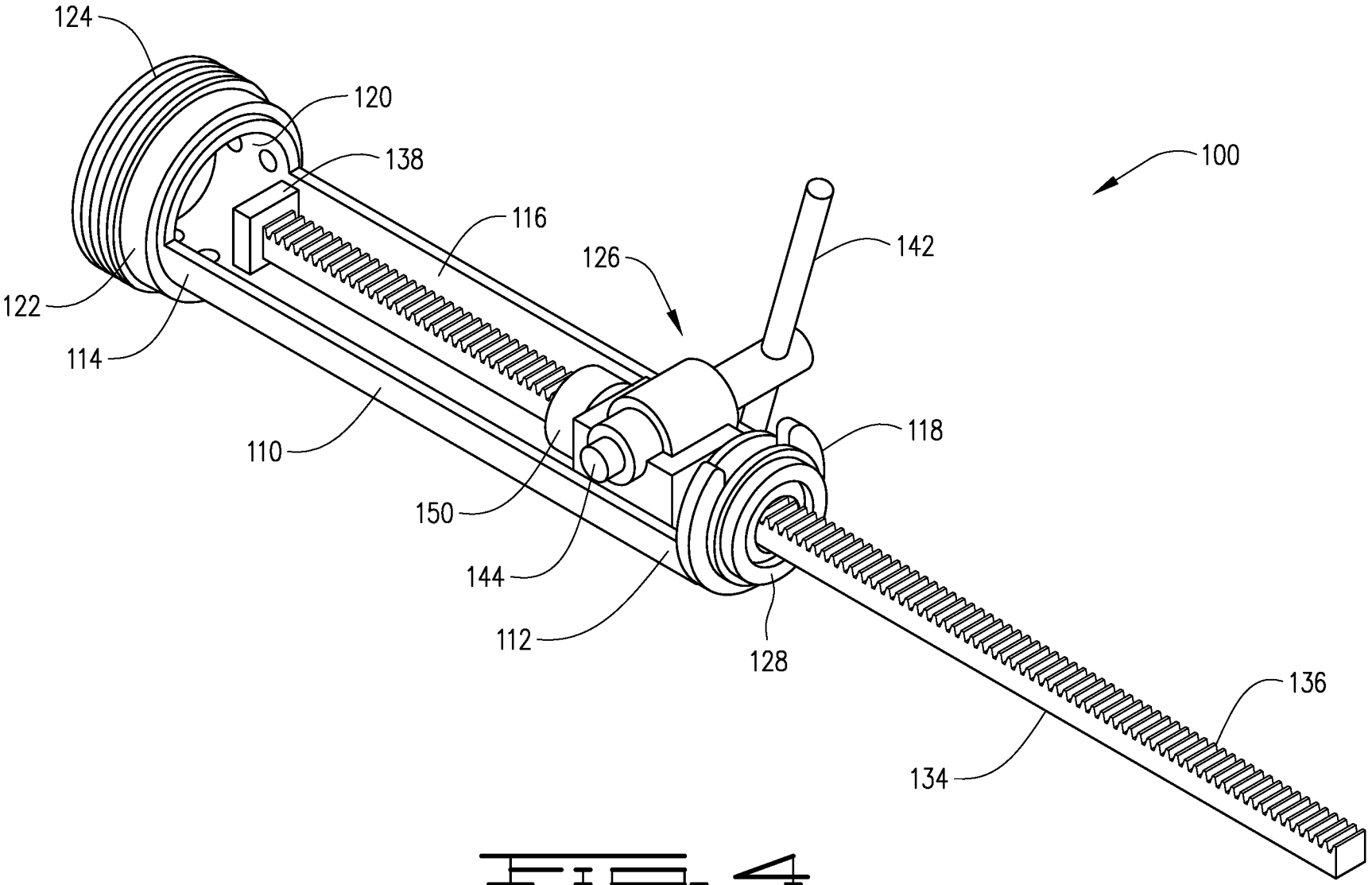
FIG. 4 is a perspective view of a plunger tool in accordance with another embodiment.

Returning now to FIGS. 2,3 and 5, actuator assembly 126 can also include a steel coupling 150 connected to gearbox 132 on the opposing side from hub 128. In the embodiment illustrated in FIGS. 2, 3 and 5, actuator assembly 126 is mounted on guide 110 such that gearbox 132 and coupling 150 extend out from first end 112 away from guide 110. FIG. 4 illustrates an alternative embodiment where actuator assembly 126 is mounted on guide 110 such that gearbox 132 and coupling 150 extend from first end 112 into guide 110.

In operation, plunger tool 100 is used to remove and hold plunger 16 from a reciprocal pump. To remove the plunger, a cover plate 20*a*, 20*b* or 20*c* is removed from the associated cylinder opening of the cylinder housing a plunger 16. Next, guide 110 is mated to the cylinder opening by screwing mating piece 122 into the cylinder opening. Attachment end 138 of rack 134 is inserted into the matching orifice in the end of plunger 16 and turned to lock rack 134 to plunger 16.

Either before or after rack 134 is locked to the plunger 16, hub 128 is positioned in bracket mount 118 so as keep actuator assembly 126 stationary with respect to guide 110. Also, at least a portion of rack 134 is slid through gearbox 132 so as to extend through gearbox 132, guide 110 and second end 114 of guide 110. Pinion bar 144 of handle 140 is introduced into gearbox 132 so that pinions 146 engage with gears 136 of rack 134.

Next, handle 140 is turned thus rotating pinion bar 144. By the engagement of pinions 146 with gear 136, rotational motion of pinions 146 results in linear motion of rack 134. The longitudinal movement of rack 134 pulls plunger 16 from the plunger cylinder. As the plunger is pulled out of the cylinder, it is pulled onto wall 116 of guide 110, which supports plunger 16. If desired, plunger tool 100 can be left attached to the cylinder opening during maintenance or disassembly of the pump, and plunger tool 100 can continue to support and store plunger 16 during the maintenance or disassembly.

After maintenance or disassembly of said reciprocal pump is complete, handle 140 is turned so as to move rack 134 and plunger 16 attached to rack 134 such that plunger 16 is moved from guide 110 into the plunger cylinder. Once the plunger is positioned in the cylinder, rack 134 can be disengaged from plunger 16 by turning attachment end 138. In some embodiments, rack 134 is slid out of gearbox 132 and actuator assembly 126 is removed from guide 110 prior to disengagement of rack 134 from the plunger. After this disengagement, the cover plate is reinstalled over the cylinder opening.

The above elements of the tool as well as others can be seen with reference to the figures. From the above description and figures, it will be seen that the present invention is well adapted to carry out the ends and advantages mentioned, as well as those inherent therein. While the presently preferred embodiment of the apparatus has been shown for the purposes of this disclosure, those skilled in the art may make numerous changes in the arrangement and construction of parts. All of such changes are encompassed within the scope and spirit of the appended claims.

What is claimed is:

1. A plunger tool for a reciprocating pump, comprising:

a guide having a first end, a second end and a wall extending from said first end to said second end, wherein said first end has a bracket mount, said wall is configured to receive and support a plunger removed from said pump;

a circular mating piece attached to said second end and configured to screw mount into a cylinder opening on said pump; and an actuator having a hub, wherein said hub has a groove that removably mates with said bracket mount so as to keep said actuator stationary with respect to said guide, said actuator is configured so as to linearly move said plunger along the wall of said guide.

2. The plunger tool of claim 1, wherein said actuator further comprises having a rack and a handle, wherein said handle interacts with said rack to control movement along said guide such that a rotational motion of said handle results in linear motion of said rack, and wherein said rack has an attachment end which is configured to attach to said plunger such that linear movement of said rack results in linear movement of said plunger.

3. The plunger tool of claim 2, wherein said actuator further comprises a gearbox attached to said hub, said gearbox is configured to slidingly receive said rack and to receive said handle.

4. The plunger tool of claim 3, wherein said handle has a pinion which interacts with said rack to control movement of said rack through said gearbox such that a rotational motion of the handle results in rotational motion of said pinion, and rotational motion of the pinion results in linear motion of said rack.

* * * * *